United States Patent [19]

Bedford

[11] 4,014,269

[45] Mar. 29, 1977

[54] SAFETY STOP FOR OVERHEAD TRACK SWITCH

[76] Inventor: Beryl A. Bedford, 701 Hurlingame Ave., Redwood City, Calif. 94063

[22] Filed: Oct. 29, 1975

[21] Appl. No.: 627,014

[52] U.S. Cl. ..... 104/250; 104/249

[51] Int. Cl.[2] ..... B61K 7/20

[58] Field of Search ..... 104/89, 93, 130, 249, 104/250

[56] References Cited

UNITED STATES PATENTS

| | | | |
|---|---|---|---|
| 967,869 | 8/1910 | Fitzgerald | 104/250 X |
| 1,155,214 | 9/1915 | Conrad | 104/250 X |
| 1,171,748 | 2/1916 | Normine | 104/250 X |

*Primary Examiner*—Stephen G. Kunin
*Attorney, Agent, or Firm*—Clarence A. O'Brien; Harvey B. Jacobson

[57] ABSTRACT

A safety stop for overhead track switches prevents a trolley on the track from rolling off an open end if the switch malfunctions. An additional feature of the safety stop are beveled portions thereof which help align the tracks being switched with the stationary portion of the track.

3 Claims, 3 Drawing Figures

10
2
2
12
13
14
15
16
17
18
18'
18'
20
22
24
26
27
28
30
31
32

12
14
15
24
26
26'
27
27
29
31
32

12
13
14
17
24
26
28
30
31
32
33
34
35
35
40
42
44

SAFETY STOP FOR OVERHEAD TRACK SWITCH

BACKGROUND OF THE INVENTION

1. Field of the Invention

This invention relates generally to an improved safety switch. An automatic safety stop is provided for a conventional type overhead track switch to prevent an overhead trolley from running off the track if the switch itself malfunctions.

2. Description of the Prior Art

Overhead track switches of both manual and semi-automatic type are well known in the prior art. A common problem with such switches has been in the provision of safety stops to prevent the overhead trolley from running off an open track in the case the switch malfunctions. The construction of the switch can be made so that the chance of a switch remaining open is decreased but normally in order to do this the operating mechanism becomes so positve in action that it is difficult and impractical to operate. If the switching mechanism is easy to operate then it is also common for it to malfunction. If a switch is left open or partially open and a trolley runs off the overhead track great damage can be the end result. Not only can expensive damage occur but also personal injury could be involved which most plants can ill afford. The following patents are known and may be pertinent to this invention. Haskins et al, U.S. Pat. No. 301,119, patented July 1, 1884; Louden, U.S. Pat. No. 891,493, patented June 23, 1908; Fitzgerald, U.S. Pat. No. 967,869, patented Aug. 16, 1910; and Ferris, U.S. Pat. No. 989,899, patented Apr. 18, 1911.

SUMMARY OF THE INVENTION

An object of the present invention is to provide an improved safety stop for an overhead track switch.

Another object of the present invention is to provide a safety switch having beveled portions associated therewith to aid in the alignment of the switching track portions of a track switch.

A still further object of this invention is to provide a positive, maintenance free, foolproof safety stop which may be easily added to conventional track switches at low cost.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
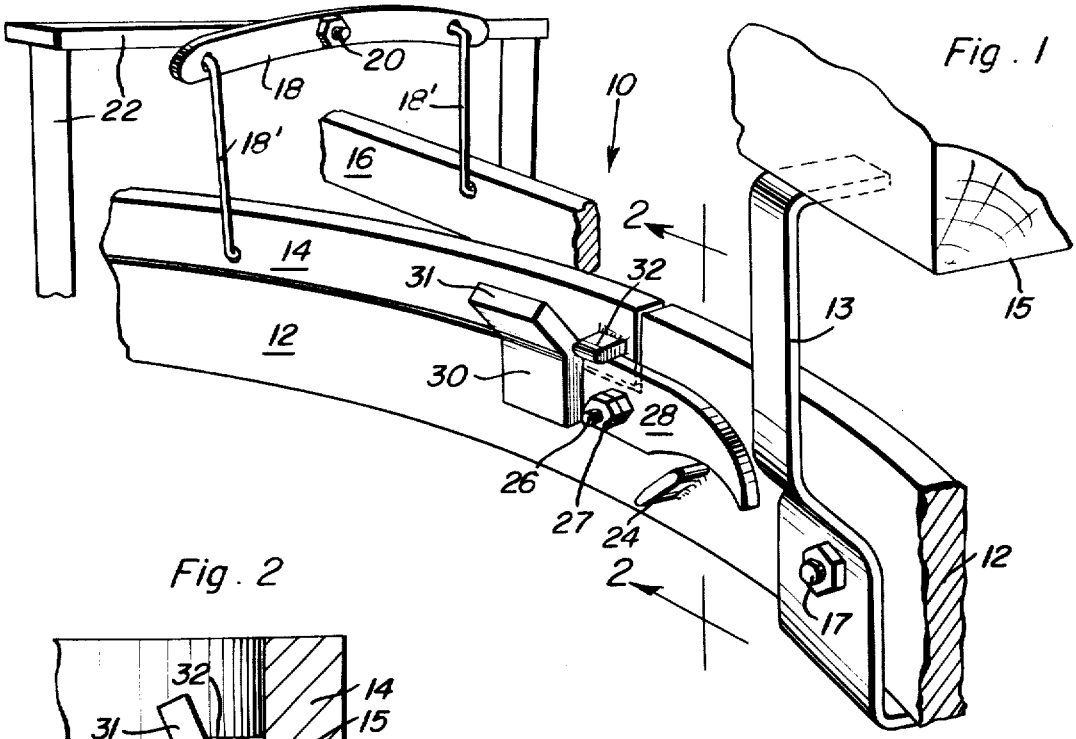
FIG. 1 is a fragmentary, perspective view, partly in section, showing a safety stop according to the present invention mounted on a track switch of conventional design.
Figure 3:
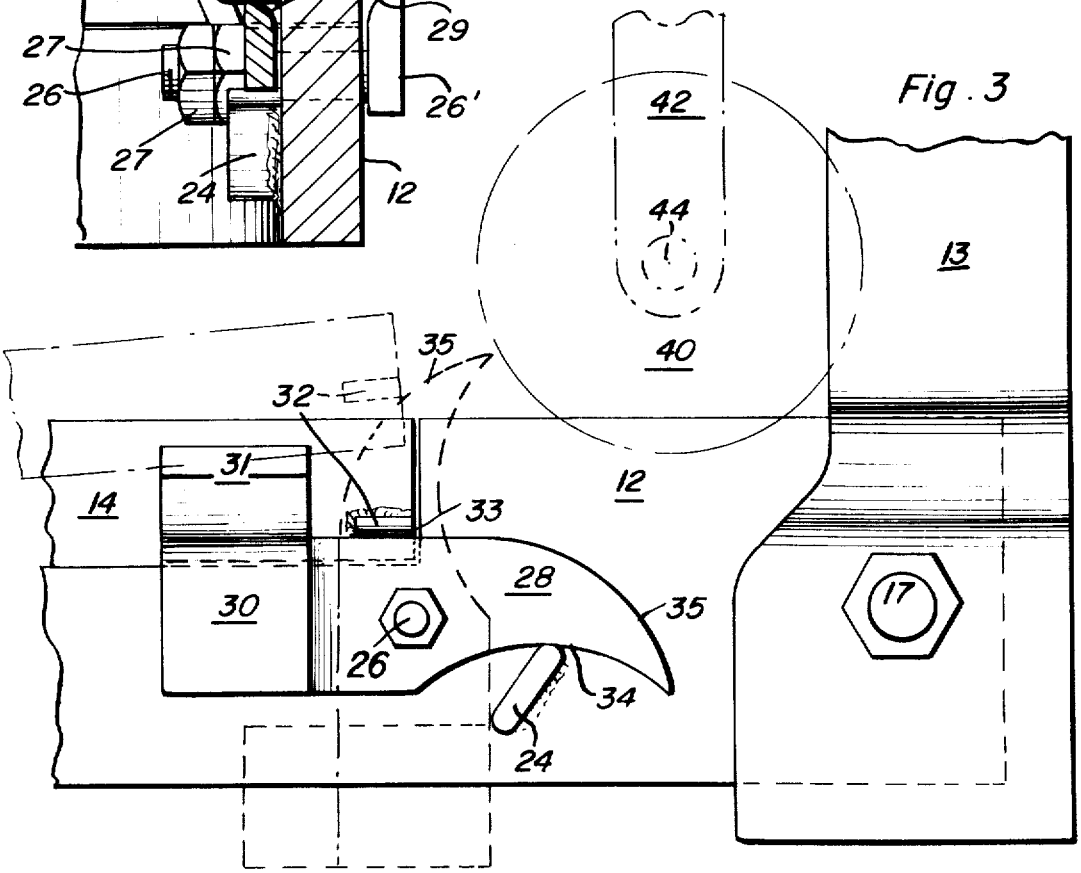
FIG. 3 is a side elevational view, in part, of the safety stop of FIG. 1 showing both the inoperative position of the stop and the operative position thereof.

Referring now to the drawing, the safety stop device of this invention is referred to generally by reference numeral 10 in FIG. 1. The safety stop is shown as mounted on a conventional track switch. The track switch comprises a main track 12 supported from an overhead building structure 15 by means of bracket 13 and nut-and-bolt 17 with movable switch tracks 14 and 16 shown, said movable switching track portions being supported by appropriate linkage 18, 18' on bolt 20 supported by frame structure 22 in the conventional well-known manner. In operation when the track portions 14 and 16 are being switched, one track or the other, will be in aligned position with the main track 12 as shown in FIGS. 1 and 3. As shown, switch track 14 is closed and in line with the main track 12. At the open end of each of these tracks a camming bracket 32 is provided. Only the one for track 14 is shown; however track 16 has one similar to it at the end thereof.

Figure 2:
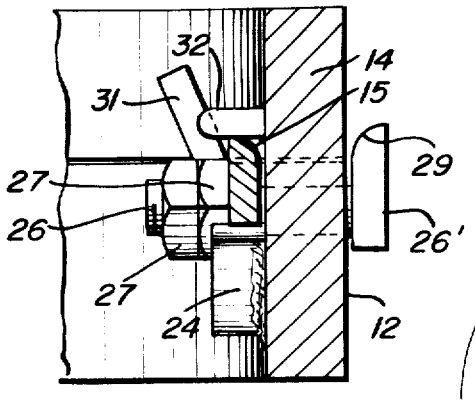
FIG. 2 is a cross-sectional view taken generally along line 2—2 of FIG. 1.

The improved safety switch of this invention will now be described. The safety stop has a main body portion 28 pivotally mounted about a bolt 26 which is supported by track 12. The head of the bolt 26', as best seen in FIG. 2, has a beveled portion at one side thereof 29 and double nuts 27 screwed on the other side of said bolt and joined together to prevent the nuts from loosening on said bolt. The safety stop 28 has a hole just slightly larger than the bolt 26 provided therein so that the stop will be freely pivotable about said bolt. The locking nuts 27 are jammed together on the bolt 26 far enough outwardly to allow free pivotal movement of stop 28. As an alternative the hole in the safety stop 28 may be larger than the bolt and an additional spacer member (not shown) provided in the hole and about the bolt to permit free pivotal movement of the stop member 28. Either way it is important that the beveled portion 29 of the bolt head 26' be aligned so that it is in the upright position as shown in FIG. 2. The uppermost inner side of the stop member 28 is also beveled as shown by the reference numeral 15 in FIG. 2. The purpose of the bevels 15 and 29 is to assist the switch tracks 14 or 16 into proper alignment with the track 12 when one or the other of these track portions are switching into closed position. As can be visualized when viewing FIG. 2, if the track portion 14 is open, i.e. in the up position, as said track drops the beveled portions 15 and 29 will center the track 14 into the proper position as the track closes.

One end of the safety stop 28 has a weight portion 30 mounted thereon with a diverging flange portion 31 extending therefrom. The main track 12 has a projection 24 provided thereon and one edge of the safety stop has an arcuate lightening recess 34 which engages the projection 24 when the stop is closed, and the weighted end 30 will be limited by projection 24 when the stop is in the open or blocking position. The outside portion of stop member 28 has a curved edge 35 which functions as a cam portion.

Looking at FIG. 3 the operation of the improved safety stop of this invention will be described. As seen in dotted lines track 14 is in the open or up position. In this open position projection 32 will permit the safety stop 28 to rotate counterclockwise around bolt 26 to the position, substantially vertical, as shown in dotted lines in FIG. 3. Stop 24 prevents the safety stop from going past the vertical position and also forms the locking stop to prevent the trolley roller 40 from pushing the safety stop 28 further than is shown in the drawing. The trolley roller 40 is attached to an appropriate car mechanism by means of bracket 42 and bolt 44 shown generally in dotted lines in FIG. 3. In the position shown in dotted lines the safety stop prevents the trolley from going off the end of the track 12 when the switch track 14 is open. Now when the switch track 14 is to be closed and starts to move in the downward direction, bracket 32 will engage the cam surface 35 of the safety stop, and as can be visualized by looking at FIG. 3, rotates the safety stop 28 in the clockwise direction around bolt 26 to the solid line position as shown. With the switch track 14 completely closed, bracket 32 will positively keep the safety stop from movement, and the trolley on the trolley support and trolley roller 40 will be permitted to pass from track 12 onto track 14, etc. If track 14 is open and there is a malfunction and track 16 does not completely close then the safety stop 28 will assume its dotted line position and prevent another trolley roller from passing past the point shown in dotted lines.

This improved safety stop is automatic in operation, simple to install and maintain, and yet positive in action. It may be used with most switching tracks in use today without any great installation problem or any great expense.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A safety stop for an overhead track switch comprising; a mounting means for attachment of the stop to a conventional overhead track, a safety stop member pivotally mounted on said mounting means, a weight for moving the stop to the safety position, the safety stop member having a cam portion for engagement with a track being switched to prevent the safety stop from functioning, the mounting means includes a bolt for attachment to an overhead track and the head of the bolt has a beveled portion for guiding a track to be switched to its normally closed position.

2. The device of claim 1 wherein the safety stop member has an inner beveled portion provided thereon to also assist in guiding a track to be switched to its normal closed position.

3. In an overhead track switch system having a main overhead track for a trolley having a trolley roller mounted on said track, at least two switchable track portions in switching alignment with said main track and having conventional switching mechanism for actuation thereof, the improvement in a safety stop for preventing the trolley roller from running off the overhead track if a switch track is inadvertently left open, said safety stop comprising; a main stop body member pivotally mounted on the main track and closely adjacent to the end of said track, means on the switching tracks for preventing said safety stop member from blocking the trolley roller, said means including a cam bracket at the end of each switching track, the main stop body member has a cam portion for actuation by said cam bracket so that when the switching track is properly closed the cam bracket at the end thereof will engage the same portion of the main stop body and hold it in the inoperative position, the main stop body member has a counterweight portion mounted thereon for positively causing the stop to block the trolley roller if the cam and cam bracket are not holding the stop body inoperative, together with a projection on the main track for the purpose of preventing the main stop body from pivoting too far, and the pivotal mounting for the main stop body includes a bolt having a beveled head and the inner upper edge of the main stop body has a similar beveled portion, both beveled portions facing each other for assisting in guiding the switching tracks to properly closed position in alignment with the main track.

* * * * *